US007419008B2

(12) United States Patent
Campisi et al.

(10) Patent No.: US 7,419,008 B2
(45) Date of Patent: Sep. 2, 2008

(54) POWER SLIP

(76) Inventors: Frank J. Campisi, P.O. Box 1177, Humble, TX (US) 77347; Jeffrey L. Bertelsen, c/o Cam-Tech Products, Inc., P.O. Box 1177, Humble, TX (US) 77347

( * ) Notice: Subject to any disclaimer, the term of this patent is extended or adjusted under 35 U.S.C. 154(b) by 47 days.

(21) Appl. No.: 11/413,693

(22) Filed: Apr. 29, 2006

(65) Prior Publication Data

US 2007/0261893 A1 Nov. 15, 2007

(51) Int. Cl.
*E21B 19/00* (2006.01)
*E21B 19/07* (2006.01)

(52) U.S. Cl. ..... 166/379; 166/77.1; 175/423

(58) Field of Classification Search ..... 175/423; 166/379, 77.1, 77.51, 77.53, 88.2; 188/67
See application file for complete search history.

(56) References Cited

U.S. PATENT DOCUMENTS 1,685,284 A * 9/1928 Harding ..... 188/67
1,725,666 A * 8/1929 Morrow ..... 188/67
1,966,454 A * 7/1934 Moody ..... 188/67
2,303,312 A * 11/1942 Sheffield ..... 254/30
2,612,671 A * 10/1952 Martin ..... 188/67
4,253,219 A * 3/1981 Krasnov ..... 188/67
4,306,339 A * 12/1981 Ward ..... 188/67
5,297,833 A * 3/1994 Willis et al. ..... 294/102.2
5,746,276 A * 5/1998 Stuart ..... 173/1
5,848,647 A * 12/1998 Webre et al. ..... 166/379
6,349,764 B1 * 2/2002 Adams et al. ..... 166/77.53
6,394,201 B1 * 5/2002 Feigel et al. ..... 175/423
2006/0065407 A1 * 3/2006 Rufey ..... 166/384

OTHER PUBLICATIONS

Den-Con Tools 2006-2007 Catalog (Den-Con Tool Company, Oklahoma City, OK)), publication date unknown.
Brochure entitled "PS-15 and PS-20 Spring Slip Assemblies," Varco Oil Tools/Varco International, Inc., Houston, TX, 1981.

* cited by examiner

*Primary Examiner*—Jennifer H Gay
*Assistant Examiner*—Cathleen R Hutchins
(74) *Attorney, Agent, or Firm*—Mark R. Wisner

(57) ABSTRACT

A power slip that utilizes modified SDXL slips and regular drilling bowls that fits to the pin drive master bushings of the rotary table and utilizes the depth of the drive pin holes as part of the actuators, thus allowing the power slip to set lower for added clearance and safety during drilling operations. Cables are anchored to a base plate and slip linkages and slip connectors are pivotally mounted to the slips and to the top plate so that, when the lift cylinders are actuated, the slips are moved to the released position. This two-stage linkage and cable design maximizes the movement of the slip assemblies while minimizing vertical movement of the power slip's housing. The base plate of the power slip is provided with a plurality of tubular pins adapted for mounting the base plate to the pin master bushing of a rotary table, and a portion of the lift cylinder is positioned in the interior hollow pins to maximize the movement of the slip assemblies upon actuation of the lift cylinders while minimizing the vertical dimension of the power slip.

14 Claims, 3 Drawing Sheets

POWER SLIP

BACKGROUND OF THE INVENTION

The present invention relates to an improved slip for gripping tubulars in a rotary table to support the tubular from the table. In more detail, the present invention relates to a power slip that provides full retraction of the slip segments that is of minimal vertical dimension for added safety and ease of use. The present invention is particularly useful for running drill pipe into and out of a well bore and for running casing pipe into a well bore.

There are various situations in which it is necessary or desirable to temporarily support the weight of a drill or casing string with tapered slips received within a tapered slip bowl while an upper joint or stand of pipe, or other structure, is being connected to or disconnected from the string. To speed the set and release of such slips, a number of power slips are available that act to move the slip segments upwardly and downwardly (relative to a co-acting slip bowl) into and out of engagement with the tapering camming surface of the bowl, and therefore into and out of engagement with the drill pipe or casing joint. Examples of such slips include the VARCO PS-15 and PS-16 (National Oilwell Varco, Houston, Tex.) power slips as well as those available from Den-Con Tool Co. (Oklahoma City, Okla.).

Although these prior power slips are in current use and function for their intended purpose, there are a number of opportunities for improvements, particularly in connection with their ease of use. One such opportunity for improvement relates to the vertical height of the power slip, and therefore its size, weight, and ease of installation. More importantly, however, a short power slip provides advantages in safety and clearance.

These advantages of safety and clearance are provided by using pins that sit down into the holes in the pin drive master bushing to provide additional vertical stroke for the cylinders that lift the slips to the raised position up and away from the drill pipe or casing, thereby providing sufficient retraction of the slips while minimizing the vertical dimension of the power slip.

The power slip of the present invention also provides an advantage over known prior art slips (such as the Varco power slip) in that it utilizes a dual linkage and independent slip assemblies. The dual linkage provides for additional stroke length in retracting the slips by folding upwardly upon itself. Independent slip assemblies (as compared to the slip assemblies in known prior art power slips, which are linked with a hinged pin connection, and retract and set the same distance at the same time) allow the power slip of the present invention to accommodate off-center drill pipe and/or casing.

Known prior art power slips utilize gravity to cause the slips to fall back into the retracted position. The Varco PS-15 and PS-16 power slips, for instance, are provided with steps on the back of the slip segments for the purpose of facilitating the falling of the slips back from the pipe. The power slip of the present invention, however, utilizes a cable to pull the slips up and back away from the drill pipe and/or casing, thus providing a positive clearance between the tubular and the opening through the power slip, all while minimizing the vertical height of the power slip and maintaining sufficient stroke to fully retract the slip segments.

It is, therefore, an object of the present invention to provide a power slip with minimal vertical height that also provides sufficient retraction of the slips to insure that the slips are raised far enough from drill pipe or casing positioned between the slips to provide sufficient clearance when in the retracted position while providing the advantages of safety and clearance off a power slip of minimal height.

Another object of the present invention is to provide a power slip that uses a modified set of SDXL slip segments (so-called "extra long slips" as known in the art), eliminating the need for a guide ring and allowing for regular drilling bowls to be used as a back-up for the slips.

Another object of the present invention is to provide a power slip that directly engages the pin drive master bushings of the rotary table, utilizing the depth of the drive pin holes as part of the actuators, thus allowing the power slip to set at a lower height.

Another object of the present invention is to provide a power slip that fits directly over the master bushing, with no panels or other equipment extending over the rotary table, reducing the likelihood of possible injury and facilitating movement by rig personnel.

Other objects, and the many advantages of the present invention, will be made clear to those skilled in the art in the following detailed description of several preferred embodiments of the present invention and the drawings appended hereto. Those skilled in the art will recognize, however, that the embodiments of the invention described herein are only examples provided for the purpose of describing the making and using of the present invention and that they are not the only embodiments of power slips that are constructed in accordance with the teachings of the present invention.

SUMMARY OF THE INVENTION

The present invention addresses the above-described problem by providing a power slip for releasably gripping a tubular comprising a base plate, a top plate, one or more lift cylinders mounted between the base plate and the top plate for raising the top plate relative to the base plate, and at least two slip assemblies. Each of the slip assemblies comprises a slip linkage pivotally mounted to the top plate, a slip connector pivotally mounted to the slip linkage at one end and adapted at the other end for pivotally mounting to a slip segment, the slip segment releasably gripping a tubular positioned between slip assemblies, a pulley mounted to the top plate, and a cable having one end anchored to the base plate and the other end anchored to either the slip linkage or the slip connector, or both the slip linkage and the slip connector, and passing over the pulley for pulling the slip segment mounted to the slip connector up and back away from a tubular positioned between slip assemblies when the top plate is raised relative to the base plate.

In another aspect, the present invention provides a method of retracting a plurality of slip segments mounted in a slip from a set position engaging a tubular positioned between slip segments to a raised position in which the slip segments are released from the tubular comprising the steps of actuating a lift cylinder to raise a top plate relative to the base plate of the power slip, thereby causing the portion of a cable anchored to the base plate that passes over a pulley mounted to the top plate to shorten relative to the top plate, rotating a slip linkage that is pivotally mounted to the top plate and to which the end of the cable passing over the pulley is anchored to rotate relative to the top plate, and rotating a slip connector that is pivotally mounted to both the slip linkage and to a slip segment relative to the slip linkage when the portion of the cable that passes over the pulley is shortened by actuating the lift cylinder. As the slip connector rotates, the slip segment to which the slip connector is pivotally mounted is raised from a downward, set position to a raised position in which the slip segment is released from a tubular.

BRIEF DESCRIPTION OF THE DRAWINGS

Referring now to the figures.

DETAILED DESCRIPTION OF THE PREFERRED EMBODIMENT(S)

Figure 1:
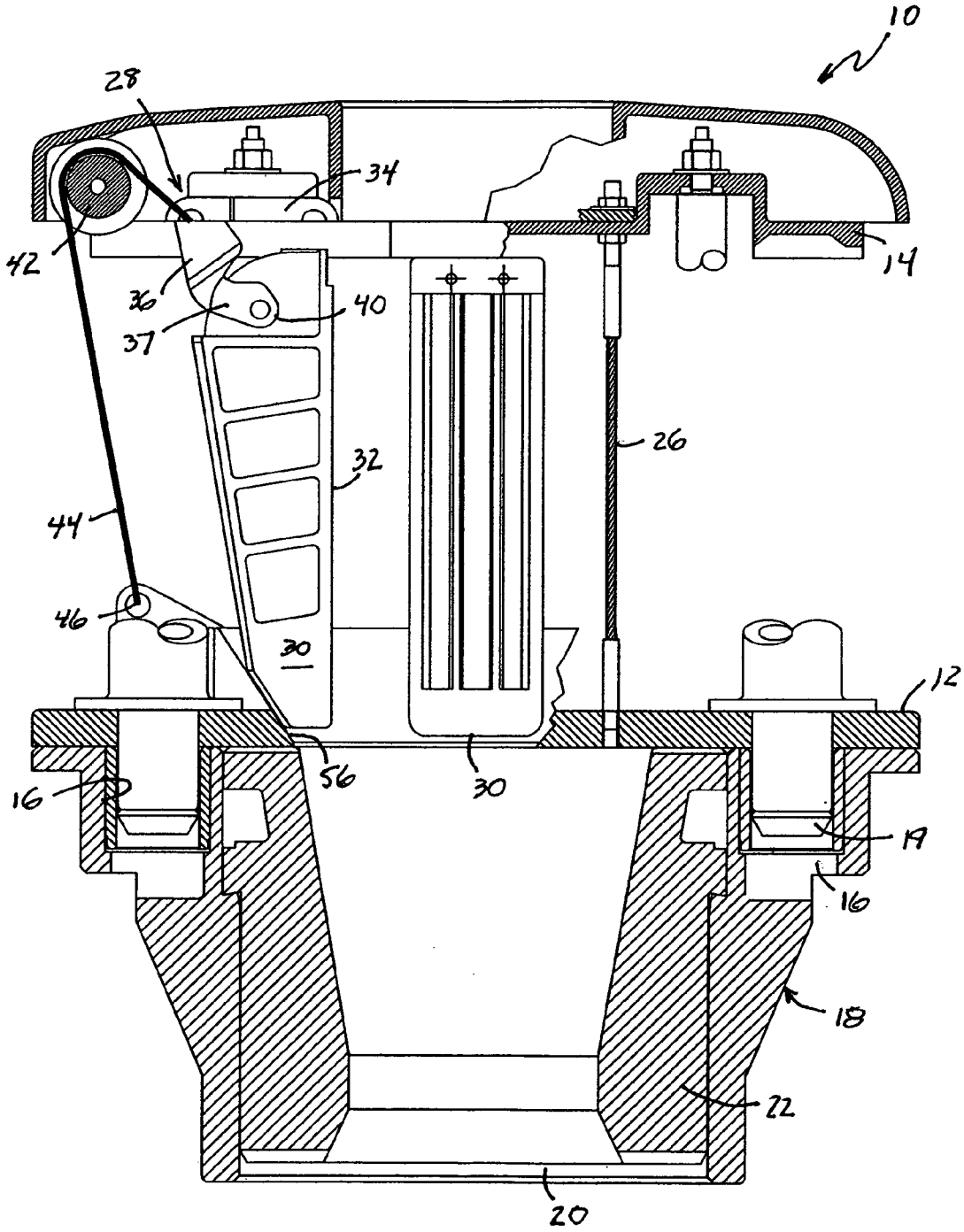
FIG. 1 shows a partially cutaway, partially sectional view of one embodiment of a power slip constructed in accordance with the teachings of the present invention in which the slip segments are in a first, released, or up, position.

In more detail, FIG. 1 shows a first embodiment of a power slip constructed in accordance with the teachings of the present invention at reference numeral 10. Power slip 10 is comprised of base plate 12 and top plate 14, the base plate 12 being provided with structure adapted for engaging the pin drive master bushings 16 of a rotary table 18 in the form of the pins 19 that sit down into the insert sleeve 21 that is threaded into bushings 16 (see also FIG. 2). A central opening 20 passes through rotary table 18 and a drilling bowl 22 of a type known in the art is engaged to the inside of rotary table 18.

Figure 2:
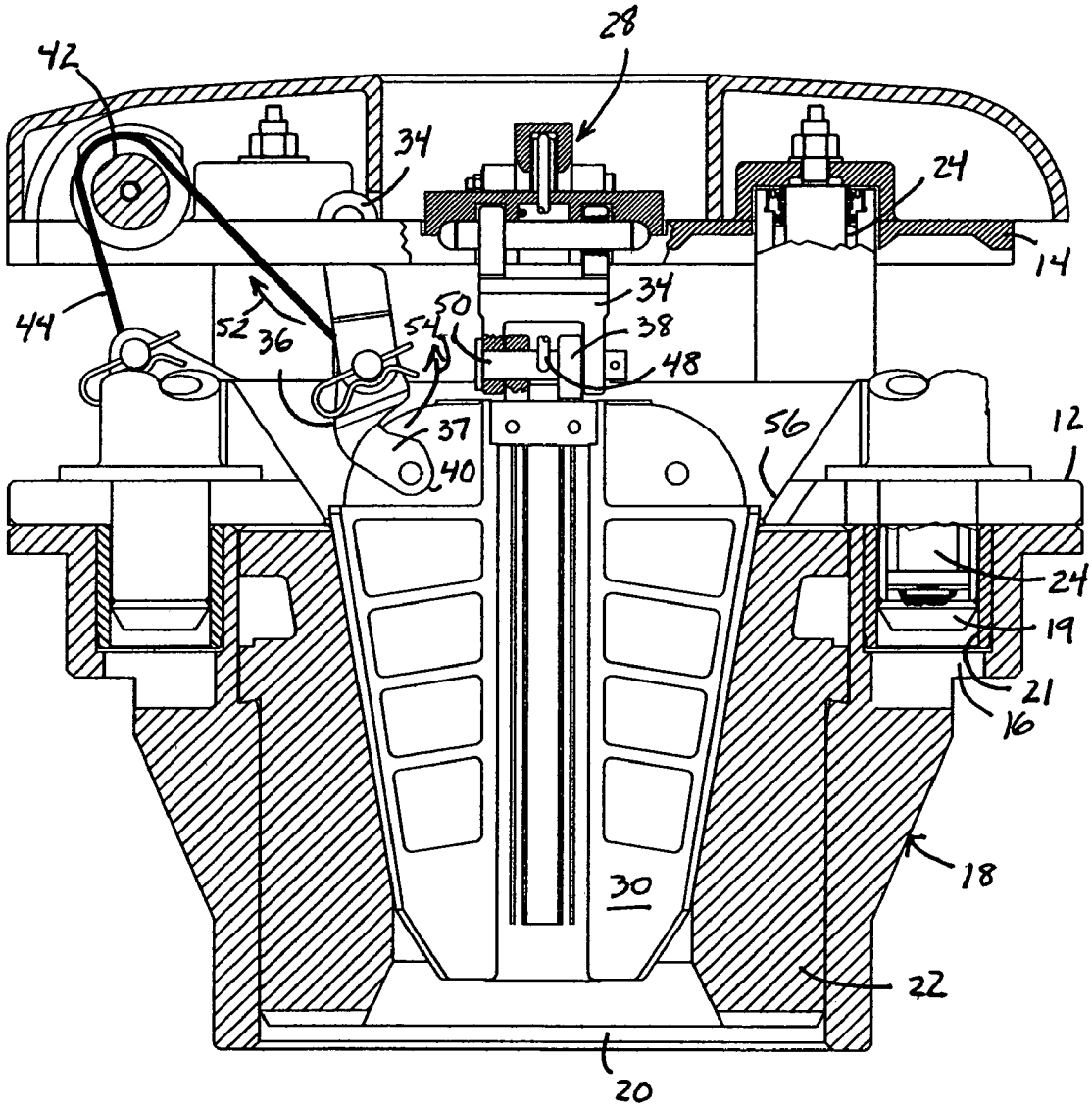
FIG. 2 shows the power slip of FIG. 1 with the slip segments in a second position engaging a tubular extending through the power slip.

One or more lift cylinders 24 is spaced radially around the periphery of the base plate 12 and mounted between the base and top plates for raising top plate 14 relative to base plate 12 when actuated. As will be apparent to those skilled in the art who have the benefit of this disclosure, the lift cylinders 24 may be hydraulic, pneumatic, or spring-loaded (by mechanical springs or air) cylinders. Referring to FIG. 2, it can be seen that the pins 19 received within the pin drive master bushings 16 are hollow and that the lift cylinder 24 is actually located in the pins 19 so that the lift cylinder is long enough to provide sufficient stroke length to fully retract slip segments 30 (as described below) while minimizing the vertical dimension of power slip 10 so as to avoid interference with other equipment at the wellhead while also increasing safety and ease of use. An adjustable tension cable 26 is mounted between base and top plates 12, 14 for limiting movement of top plate 14 relative to base plate 12.

Figure 3:
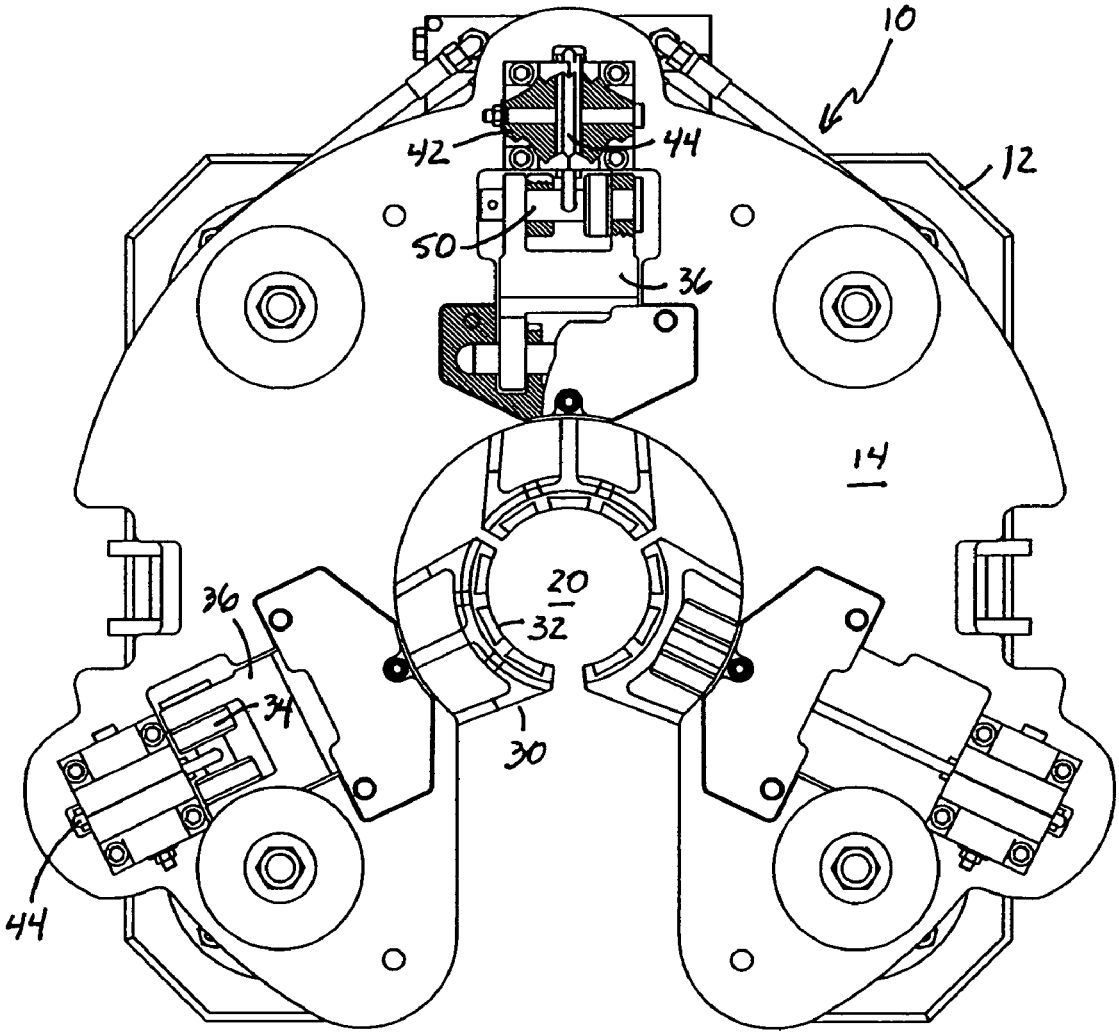
FIG. 3 is a top, plan view of the power slip of FIG. 1 with the cover removed and showing portions of the power slip in cutaway and sectional view.

Referring now also to FIG. 3, a plurality of slip assemblies, indicated generally at reference numeral 28, are radially spaced around the base and top plates 12, 14. In the preferred embodiment shown, three slip assemblies 28 are provided (instead of, for instance, four) so that each slip segment 30 has a wider face 32 for engaging the outside diameter of the tubular (not shown) positioned between slip assemblies 28 and passing downhole through power slip 10, making it easier to center the tubular on each slip segment 30 and leaving less room between segments 30 for the tubular to be damaged or to get trapped off-center. Those skilled in the art will recognize, however, that satisfactory function is obtained in the power slip of the present invention with four or more radially-spaced slip segments and that, although it would likely not function optimally, the power slip of the present invention would be capable of operating with as few as two slip assemblies 28.

Each slip assembly 28 is comprised of a slip linkage 34 that is pivotally mounted to top plate 14 and a slip connector 36 that is pivotally mounted to slip linkage 34 at one end 38 and adapted at the other end 40 for pivotally mounting to a slip segment 30. A pulley 42 is mounted to top plate 14 and a cable 44 having one end 46 anchored to base plate 12 and the other end 48 anchored to the linkage pin hanger 50 passes over pulley 42. Although shown in the preferred embodiment as being anchored to the linkage pin hanger 50, those skilled in the art who have the benefit of this disclosure will recognize that the end 48 of cable 44 can also be anchored to either the slip linkage 34 or the slip connector 36, linkage pin hanger 50 providing the pivot point between slip linkage 34 and slip connector 36. In this same regard, in the preferred embodiment shown, slip connector 36 is provided with an angled portion 37 that provides mechanical advantage and additional rotation resulting from the pivoting of the slip connector 36. For this reason, slip connector 36 is described herein as being "J"-shaped, but those skilled in the art will recognize from this description that slip connector 36 need not be "J"-shaped to function for its intended purpose and/or that slip connector may be "L"-shaped or shaped in other shapes that provide the mechanical advantage and additional rotation described herein.

Referring now to FIG. 2, which shows the slip segments 30 in lowered position in which they would engage a tubular positioned therebetween, it can be seen that the configuration of the slip assemblies 28 described and shown herein causes the slip linkage 34 and slip connector 36 to pivot as pulley 42 rotates under cable 44 as top plate 14 is raised relative to base plate 12 by lift cylinders 24. The lift cylinders 24 are actuated on the drilling floor by, for instance, stepping on a foot pedal (not shown) that is connected to a valve that raises top plate 14. A hand valve (also not shown) is also provided at the driller's panel for actuating (or releasing) the lift cylinders 24. In more detail, upon actuation of the lift cylinders 24 to raise top plate 14, slip linkage 34 is pivoted in the direction of arrow 52 in FIG. 2 by action of cable 44, pulling slip connector 36 in that same direction. As a result, slip connector 36 pivots relative to slip linkage 34 in the direction of arrow 54 until the slip connector 34 and slip linkage 36 reach the position shown in FIG. 1. As a result of the action of this dual linkage, slip linkage 36 acts as a clevis such that the slip segment 30 mounted to slip connector 36 is pulled up and back, or radially outwardly, from a tubular positioned between slip assemblies 28 as top plate 14 is raised relative to base plate 12. This movement of slip segments 30 from the position shown in FIG. 2 engaging a tubular positioned between slip assemblies 28 to the raised position, back and away from a tubular by the pivoting of dual linkage slip assembly 28, is illustrated by comparison of FIGS. 1 and 2. To facilitate movement of the slip segment 30 from the set position engaging a tubular positioned between slip assemblies 28 to the raised position back and away from the tubular, base plate 12 is provided with a surface 56 for engaging the outside surface of the slip segment 30 mounted to slip connector 36 to guide the slip segment 30 during upward and/or downward movement.

As noted above, the angled portion 37 of slip connector 36 provides additional rotation and mechanical advantage to the retraction of the slip segment 30 from a tubular positioned between slip assemblies 28. Similarly, the positioning of the pulley 42 on top plate 14 radially outwardly (relative to the tubular positioned between slip segments 30) from the pivoting connection between slip linkage 34 and top plate 14 provides a mechanical advantage to the pivoting of the dual linkage slip assembly 28. Likewise, the pivotal connection between slip connector 36 and slip segment 30 is positioned radially inwardly of the pivotal connection between slip linkage 34 and top plate 14 when the slip segment 30 engages a tubular for this same reason.

Those skilled in the art who have the benefit of this disclosure will recognize that certain changes can be made to the component parts of the apparatus of the present invention without changing the manner in which those parts function and/or interact to achieve their intended result. By way of example, those skilled in the art who have the benefit of this disclosure will recognize that a pulley is not required for proper function of the power slip 10 shown herein. Instead, cable 44 could pass over a roller, or even a polished concave surface formed in a shoulder that is formed in or integrally mounted to top plate 14. It will also be recognized by those skilled in the art that cable 44 need not pass over pulley 44 at all and that the length of cable 44 extending from pulley 42 to slip linkage 34 could be replaced by a lever arm pivoted at approximately the same location as the mount for pulley 42 and pivotally mounted to slip linkage 34, that is actuated by cable 44. Alternatively, a chain, cam linkage, or cam follower, can be utilized to provide the pivoting, rotational motion of the dual linkage described herein to retract the slip segments 30 from the set position to the raised position. All such changes, and others that will be clear to those skilled in the art from this description of the preferred embodiments of the invention, are intended to fall within the scope of the following, non-limiting claims.

What is claimed is:

1. A power slip for releasably gripping a tubular comprising:

a base plate;

a top plate;

one or more selectively actuated lift cylinders mounted between said base plate and said top plate for raising said top plate relative to said base plate; and at least two slip assemblies, each of said slip assemblies comprising:

a slip linkage pivotally mounted to said top plate;

a slip connector pivotally mounted to the slip linkage at one end and adapted at the other end for pivotally mounting to a slip segment for releasably gripping a tubular positioned between said slip assemblies;

a pulley mounted to said top plate; and a cable having one end anchored to said base plate and the other end anchored to either the slip linkage or the slip connector, or to both the slip linkage and the slip connector, and passing over the pulley for pulling a slip segment up and back away from a tubular positioned between said slip assemblies when said top plate is raised relative to said base plate by actuating said lift cylinders.

2. The power slip of claim 1 additionally comprising one or more tension cables mounted between said base plate and said top plate for limiting movement of said top plate relative to said base plate.

3. The power slip of claim 1 wherein said lift cylinders are air, hydraulic, or spring-loaded cylinders.

4. The power slip of claim 1 wherein said base plate is provided with a surface for guiding a slip segment during upward and/or downward movement.

5. The power slip of claim 1 wherein the cable is anchored to the pivotal joint between the slip linkage and the slip connector.

6. The power slip of claim 1 wherein the pulley is mounted to said top plate at a position spaced radially outwardly of the tubular positioned between said slip assemblies and the pivoting connection between the slip linkage and said top plate.

7. The power slip of claim 1 wherein the slip connector is "J"-shaped.

8. The power slip of claim 1 wherein the pivotal connection between the slip connector and the slip segment is positioned radially inwardly of the pivotal connection between the slip linkage and said top plate.

9. The power slip of claim 1 wherein said base plate is provided with at least two tubular pins adapted for mounting said base plate to the pin drive master bushing of a rotary table, a portion of each of said lift cylinders being positioned in a respective hollow interior of one of said pins.

10. A method of retracting a plurality of slip segments mounted in a slip from a set position to a raised position in which the slip segments are released from a tubular positioned between slip segments comprising the steps of:

actuating a lift cylinder to shorten the portion of a cable anchored to a base plate that passes over a pulley mounted to a top plate relative to the top plate;

rotating a slip linkage that is pivotally mounted to the top plate and to which the end of the cable passing over the pulley is anchored relative to the top plate; and rotating a slip connector relative to the slip linkage when the portion of the cable that passes over the pulley is shortened by actuating the lift cylinder, thereby raising the slip segment to which the slip connector is mounted from a downward, set position to a raised position in which the slip segment is released from the tubular.

11. The method of claim 10 in which the slip linkage and the slip connector are rotated simultaneously.

12. The method of claim 10 in which the slip segment is raised from the set position to the released position by moving the slip segment toward the pulley over which the cable passes.

13. The power slip of claim 1 wherein the slip connector comprises an angled portion.

14. The power slip of claim 1 wherein the pulley is mounted on the top of said top plate.

* * * * *